United States Patent [19]

Spinosa et al.

[11] 4,027,386

[45] June 7, 1977

[54] CUTTING IMPLEMENT

[75] Inventors: Dominic J. Spinosa, Wantagh; Edward R. Camillucci, Commack, both of N.Y.

[73] Assignee: East/West Industries, Inc., Farmingdale, N.Y.

[22] Filed: Oct. 22, 1975

[21] Appl. No.: 624,718

[52] U.S. Cl. ..... 30/53; 30/156; 30/339

[51] Int. Cl.[2] ..... B26B 21/10; B26B 5/00

[58] Field of Search ..... 30/53–55, 30/151, 156, 161, 337, 338, 339, 2

[56] References Cited

UNITED STATES PATENTS

| | | | |
|---|---|---|---|
| 1,073,581 | 9/1913 | Humphrey | 30/156 |
| 1,599,604 | 9/1926 | Wetmore | 30/156 |
| 1,728,992 | 9/1929 | Frank | 30/156 |
| 1,947,751 | 2/1934 | Witter | 30/156 |
| 2,628,423 | 2/1953 | Cuntz | 30/156 |
| 3,430,339 | 3/1969 | Hobson | 30/151 X |
| 3,797,505 | 3/1974 | Gilhaus | 30/2 X |

*Primary Examiner*—Gary L. Smith

[57] ABSTRACT

This invention provides a cutting implement having supporting means with a blade having a sharp cutting edge extending from one side thereof, with handle means pivotally connected to the supporting means and extending around the cutting edge in the closed position of the implement. The cutting surface of the blade is exposed by the user gripping the supporting means or the handle means and by pivoting the handle means away from the supporting member, or visa versa, about 180° to open the implement. By providing the cutting surface in a completely enclosed position when not in use, no injury could occur to the user.

When the cutting implement is not in use, the handle means extends in overlapping relation to the supporting means and the exposed portion of the blade extends within chamber means extending within the handle means. Locking means is provided to retain the supporting means in its overlapping position with the handle means when not in use and gripping means may be provided on the handle means to assist the user.

24 Claims, 13 Drawing Figures

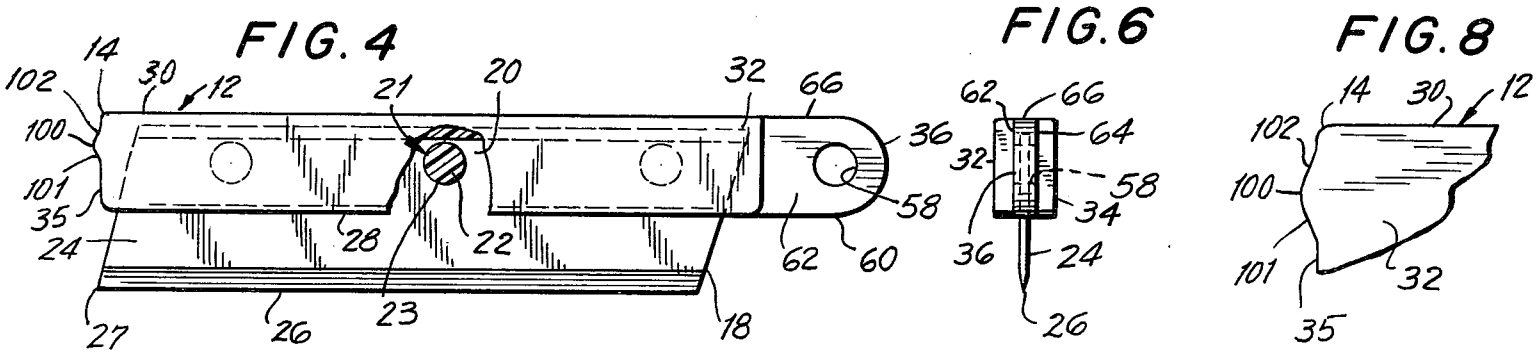
FIG. 8
FIG. 6
FIG. 4
12
30
14
102
100
101
35
32
58
34
64
66
24
26
62
36
60
18
20
22
21
23
28
27
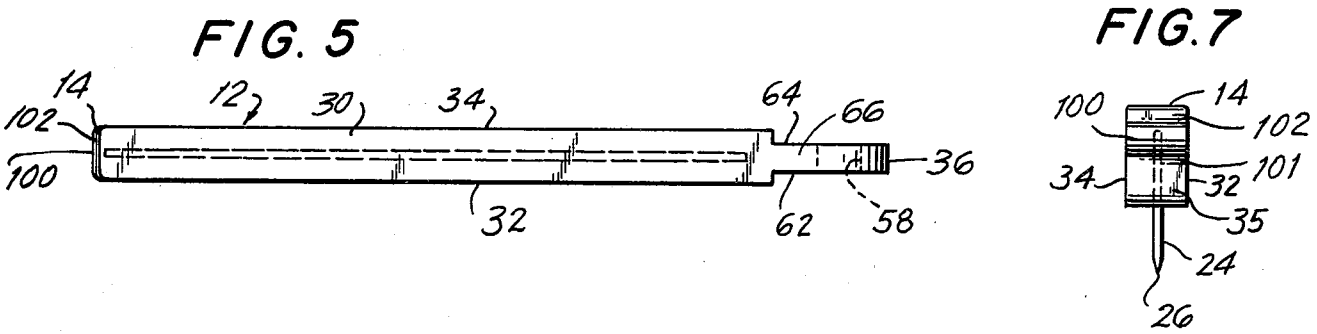
FIG. 7
FIG. 5
14
102
101
32
35
24
26
100
34
36
58
66
64
62
12
30

CUTTING IMPLEMENT

BACKGROUND OF THE INVENTION

The invention relates generally to cutting implements and more particularly to a universal device for cutting objects, field surgery, shaving, etc., having a cutting edge associated therewith that is fully enclosed and out of view to protect the user and easily openable to expose the cutting edge.

The cutting implement of the present invention permits the user to avoid the prior problems encountered when trying to open a "razor blade" type cutting implement in that the user cannot always judge the force required to open the implement and more often that not may break a nail in opening the implement. Particularly, when the knife edge is as in a razor blade in which a thin delicate edge is exposed, it becomes more important to safeguard the cutting edge when not in use.

To overcome the prior ar problems, applicants have invented a cutting implement that in its closed position has a substantially rectangular form, although other shapes may be selected, such that in effect it does not even have the appearance of a knife. In this manner the blade is out of view and the chance of it being exposed to moisture or breakage is eliminated. Yet with a simple motion, the two sections are brought into the open position of the implement and ready for use.

OBJECTS OF THE INVENTION

An object of the present invention is to provide a cutting implement in which the blade is completely hidden from view in the closed position thereof.

Another object of the present invention is to provide a cutting implement having supporting means and handle means pivotably joined together to completely contain the blade during non-use thereof.

Another object of the present invention is to provide a cutting implement that may be easily opened for use to expose the razor type blade mounted therein.

Other objects of the present invention will become apparent as the disclosure proceeds.

SUMMARY OF THE INVENTION

The invention is for a cutting implement which provides for the cutting surface to be in a completely enclosed position when not in use, so that no injury could occur to the blade or the user.

The implement includes supporting means in the form of an elongated body portion having a front surface and mounting means for securing a blade in fixed position relative to the supporting means wherein a portion of the blade extends within the body portion and the blade edge extends in substantially parallel spaced relation to the front surface of the body portion and spaced a distance from each end of the supporting means. Handle means is provided including an elongated body protion having a front surface with chamber means extending longitudinally in the handle means along the front surface of the body portion and adapted to contain the blade therein in the closed position of the cutting implement.

Securing means pivotally connects the supporting means to the handle means so as to provide relative angular displacement of the supporting means relative to the handle means at substantially one end thereof from a closed position in which the front surfaces of the supporting means and handle means are in overlapping abutting relation to each other with the blade extending within the chamber means, to an extended position wherein the cutting edge is exposed for use thereof. Stopping means is provided and co-acts between the supporting means and the handle means for limiting the travel of the supporting means relative to the handle means from its closed to open position. In the open position of the implement the front surfaces of the supporting means and handle means extend in substantially horizontal planes, and in the closed position the blade is contained within the supporting means and housing means and not visible. The closed implement is of a rectangular shape that is compact and easily opened and closed. Locking means associated with the handle means and supporting means is provided to retain the latter in a releasable fixed position in the closed position of the implement.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 4 is a side elevational view, partly in section, of the supporting means;

FIG. 5 is a top view of the supporting means illustrated in FIG. 4;

FIG. 6 is a right end view of the supporting means illustrated in FIG. 4;

FIG. 7 is a left end view of the supporting means illustrated in FIG. 4;

FIG. 8 is an enlarged fragmentary view of the catch illustrated in FIG. 4;

PREFERRED EMBODIMENT OF THE INVENTION

Figure 1:
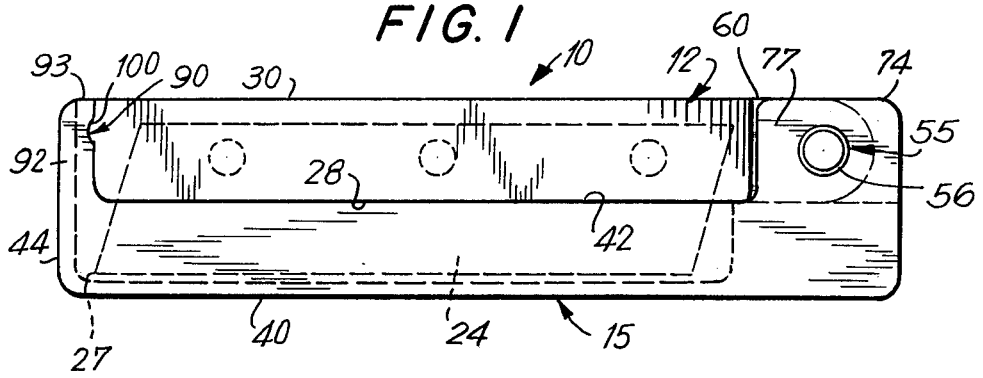
FIG. 1 is a side elevational view of the cutting element in its closed position.
Figure 2:
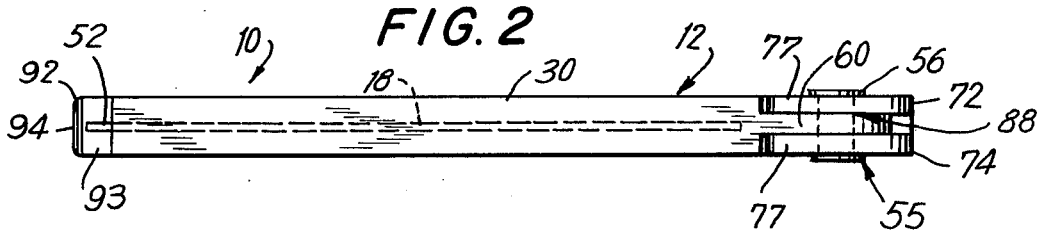
FIG. 2 is a top elevational view of the cutting element as illustrated in FIG. 1.
Figure 3:
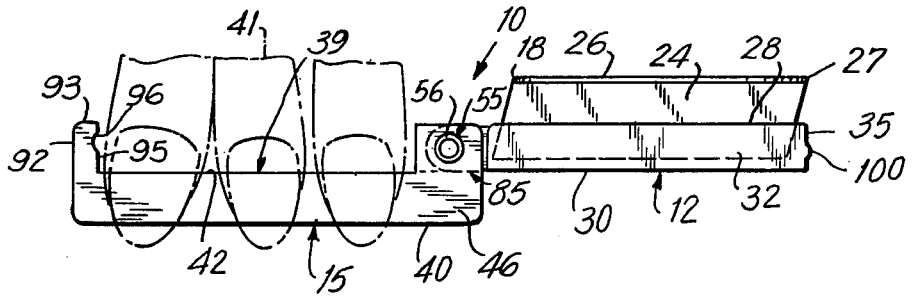
FIG. 3 is a side elevational view of the cutting element in its open position.
Figure 11:
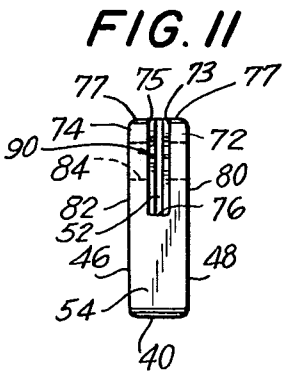
FIG. 11 is a right end view of the handle means illustrated in FIG. 9.
Figure 9:
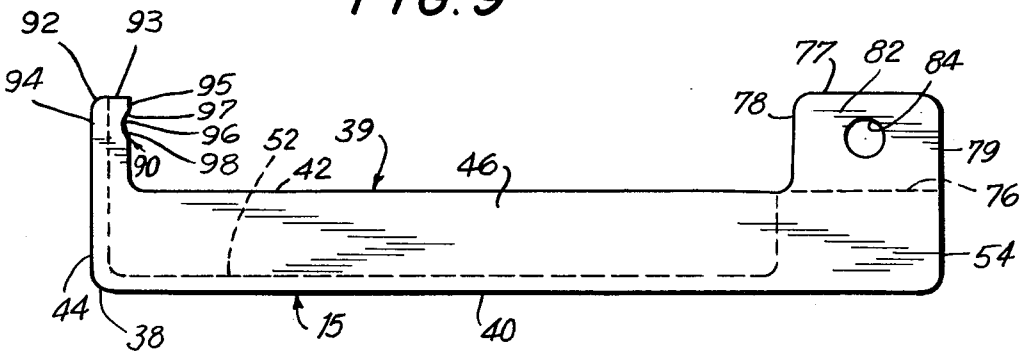
FIG. 9 is a side elevational view of the handle means.
Figure 10:
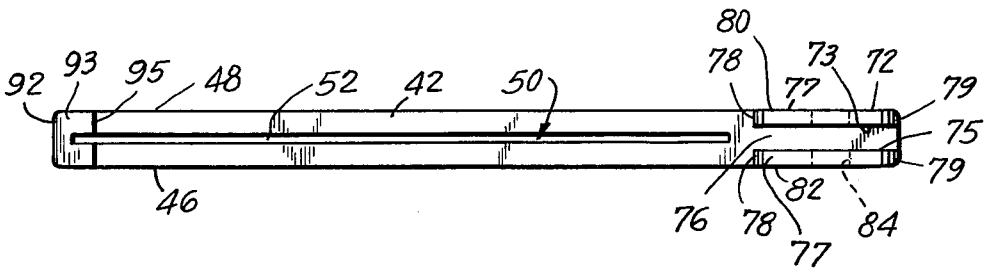
FIG. 10 is a top view of the handle means illustrated in FIG. 9.
Figure 12:
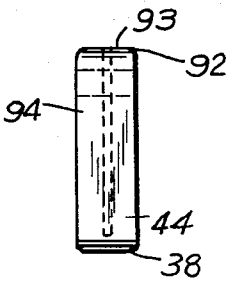
FIG. 12 is a left end view of the handle means illustrated in FIG. 9.
Figure 13:
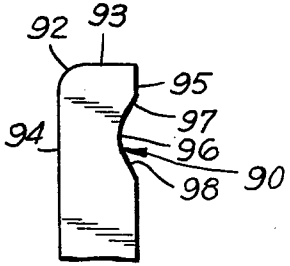
FIG. 13 is an enlarged fragmentary view of the detent illustrated in FIG. 9.

Referring to the drawings and initially to FIGS. 1, 2, and 3, we have illustrated a cutting implement generally indicated by the reference numeral 10 which includes cooperating elements in the form of supporting means 12, movably attached to handle means or sheath 15, both of which may be made out of a plastic material. The present cutting implement 10 is approximately 2¾ inches long × 3/16 inch wide × 11/16 inch high. Accordingly, the handle means may be of a transparant plastic to permit visual inspection of the blade positioned therein. This avoids opening of the knife for inspection purposes.

FIGS. 4–8 illustrate the supporting means 12 in its unassembled relationship to the handle means 15 to facilitate a clearer illustration of the invention. The supporting means 12 includes an elongated body portion 14 designed to accommodate an elongated this "razor" like blade 18 such that the rear portion 20 of the blade 18 extends within the supporting means 12. As illustrated in FIG. 4, the blade 18 is fixedly secured by mounting means 21 which may be in the form of three transverse tongues or pins 22 extending through the openings 23 contained with the blade 18. The holes 23 in the blade 18 are selected of a size that if the supporting means 12 is injection molded around the blade, that the holes 23 are large enough to permit a flow of plastic therethrough. In the alternative the tongues 22 may be separate pins that extend transversely through the blade 18 and body portion 14.

The front portion 24 of the blade 18 includes a longitudinally extending cutting edge 26 terminating at a leading edge or tip 27 and extends beyond the front surface or edge 28 of the supporting means 12. The rear surface or edge 30 of the supporting means 12 extends in substantially parallel spaced apart relation to the front surface 28. The side surfaces 32 and 34 are of a width to permit easy grasp of the supporting means 12 by the user and extend in a plane substantially parallel to each other and substantially perpendicular to the front surface 28 and rear surface 30. The end surface 35 extends in a plane substantially perpendicular to the front, rear, and side surfaces. The coupling end 36 of the body portion 14 is hereinafter discussed.

Accordingly, the mounting means 21 for securing the blade 18 in fixed position relative to the supporting means is so designed such that the exposed portion 24 of the blade 18 extends in substantially parallel spaced apart relation to the front surface of the body portion 14 and a distance from the end surface 35. The blade 18 is mounted along a plane substantially equidistant from both sides 32 and 34.

The cutting implement 10 which is used to slice or cut a variety of objects is provided with the handle means 15 which is to be used to hold the implement 10 during operation so as to avoid the user keeping his fingers near the cutting edge 26. FIGS. 9–13 illustrate the handle means 15 in its unassembled relationship to the supporting means 12 to facilitate a clearer illustration of the invention. The handle means 15 includes an elongated body portion 38 having gripping means 39 for accommodating the fingers 41 of the user as seen in FIG. 3 and hereinafter further discussed. The elongated body portion 38 includes a rear surface 40 and a front surface 42 in substantially parallel spaced relation to each other. Side surfaces 46 and 48 extend in substantially parallel spaced relation to each other and in a plane perpendicular to the front surface 42. An end surface 44 may be in a plane substantially perpendicular to the respective front, side, and rear surfaces.

Chamber means 50 extends longitudinally on the front surface 42, along a plane substantially equidistant from both sides 46 and 48 of the handle means 15. The chamber means 50 may be in the form of an elongated recess or channel 52 and spaced a distance from the end surface 44 of the handle means 15. The width, length, and depth of the channel 52 is adapted to contain the front portion 24 of the blade 18 when the implement 10 is in its closed position, as seen in FIGS. 1 and 2. The couupling end 54 of the body portion 38 is in spaced relation to the end surface 44 and is hereinafter discussed.

Securing means 55 is provided and pivotally connects the supporting means 12 to the handle means 15 so as to provide relative angular displacement of approximately 180 degrees of the supporting means 12 relative to the handle means 15. Securing means 55 is provided at substantially one end of the handle means 15 and supporting means 12 such that in the closed position, as seen in FIGS. 1 and 2, the front surfaces 28 and 42 of the supporting means 12 and the handle means 15, respectively, are in overlapping abutting relation to each other with the blade portion 24 extending within the chamber means 50 and the respective side surfaces 32 and 46 lie in a substantially horizontal plane and the side surfaces 34 and 48 lie in a substantially horizontal plane and the end surfaces 35 and 44 similarly lie in a horizontal plane so as to obtain substantially a rectangular configuration to the implement 10. In the open, extended position, as seen in FIG. 3, the cutting edge 26 is exposed and the front surfaces 28 and 42 extended in a substantially horizontal plane. Similarly the rear surfaces 30 and 40 extend in a substantially horizontal plane.

The securing means 55 includes a fastener 56 which may be in the form of a rivet, etc., that extends through a hole 58 contained in a tab 60 at the coupling end 36 of the supporting means 12. The coupling tab 60 extends from one end of the body portion 14 and includes an ear having one end 36 of a circular configuration and flat spaced apart sides 62 and 64. The flat sides 62 and 64 are spaced apart a distance less than the side surfaces 32 and 34, thereby defining an abutting surface 66 that may extend in the same plane as rear surface 30. The center of the hole 58 may be centrally located between the front surface 28 and rear surface 30 of the supporting means 12.

The coupling end 54 of the body portion 38 includes spaced apart elements or fingers 72 and 74 having inner surfaces 73 and 75 respectively that define a channel 76 therebetween to accommodate the tab 60 extending therein with an upper surface 77, front surface or edge 78, and rear surface 79. The outer surfaces 80 and 82 of the elements 72 and 74 respectively may be flush with the side surfaces 48 and 46 respectively. An opening 84 extends transversely through the pair of elements 72 and 74 and is in alignment with the opening 58 when the tab 60 extends in the channel 76. The edge 66 of the tab 60 abuts the channel wall 76 to limit the travel of the supporting means 12 relative to the handle means 15. The fastener 56, when secured in place, retains under compression the overlappping surfaces of the tab 60 and elements 72 and 74.

The retaining means 88 is provided for maintaining the handle means 15 and supporting means 12 in a releasable fixed position when the open position as seen in FIG. 3 of the implement 10 is obtained. In this manner a certain force is required to overcome the friction between the abutting surfaces 62 and 75 and 64 with 73 in order to close the implement 10. This is necessary such that the weight of the supporting means 12 in and of itself does not close the implement 10. This is accomplished by the compressive force applied by the fastener 56 in its assembled relation through to openings 58 and 84.

The stopping means 85 co-acts between the handle means 15 and supporting means 12 for limiting the travel of each other from the closed to open position, wherein in the open position of the implement 10 the front surfaces 23 and 42 remain in a substantially horizontal plane and in the closed position blade 18 is contained within the supporting means 12 and handle means 15 and not visible. The stopping means 85 includes the surface 66 of the tab 60 on the body portion 14 of the supporting means 12 with the face extending in a plane substantially parallel to the mating abutting surface 76 defined by the bottom of the channel when the implement 10 is in its open position as seen in FIG. 3. In this manner, the pivotal movement or travel is limited by the surfaces 66 and 76 that are provided to abut each other.

The locking means 90 includes a detent and catch to snap securely in place to assure the fact that the pivotally connected supporting means 12 and handle means 15 of the implement 10 will not inadvertently open and that a positive force is required for separation therebetween by the user. The locking means 90 is associated with the handle means 15 and supporting means 12 to retain the latter in a releasable fixed position in the closed position of the implement 10. The locking means 90 includes an element or arm 92 extending from the front surface 42 of the handle means 15 at substantially one end thereof and terminating in a top edge or terminal end or surface 93 that extends in substantially the same horizontal plane as the terminal end or upper surface 77 of the elements 72 and 74. The front edge or surface 94 of arm 92 is in the same vertical plane as the end surface 44 of the body portion 38. The inner edge or surface 95 of the arm extends in a plane substantially parallel to the front surface 94 and contains a recess or detent 96 having an inwardly extending leading edge 97 and an outwardly extending edge terminating at the inner surface 95 and forming a contoured seat to receive a catch. The arm 92 has the dimensional size as to be deflectable outwardly when the user pivots the securing means 12 from the open position in FIG. 3 to the closed position in FIG. 1. In the closed position the rear surface 30 defines a common plane with the terminal ends 93 of element 92, and terminal ends 77 of elements 72 and 74 so as to provide the upper rectangular surface to the implement 10. In the open position as seen in FIG. 3, the rear surface 42 is substantially in a common plane with the front surface 30.

The front surface 35 has a protusion or catch 100 extending outwardly therefrom for locking engagement with the seat 96, and formed by a leading outwardly extending edge 101 that then tapers inwardly by edge 102 that merges with the surface 35. The channel 52 extends vertically up the arm 92 and terminates at the terminal surface 93. In this manner the blade 18 being pivotally mounted moves through an arc in which the tip edge 27 clears the channel 52 in the arm 92. The alignment of the catch 97 and detent or recess 96 is such that the fit therebetween is such that the catch 97 is adapted to extend within the recess 96 in a friction fit. The closing of the implement 10 takes place by the catch 100 first engaging the leading edge 95 of the arm 92 and deflecting it outwardly as the user continues to press against the surface 30 of the supporting means 12. This deflection permits the continued downward movement of the catch 100 until the tip thereof reaches the inclined surface 97 and rides into the seat formed by the recess 96 wherein surface 97 with 102, and 98 with 101 abut each other. In opening of the cutting implement is from the position in FIG. 1 to that of FIG. 3 the arm 92 is again deflected outwardly to permit the catch 100 to be released from its enclosure of the dentent 96. The catch 100 is in resilient compressed engagement with the inclined walls 97 and 98 of the recess 96 to provide the friction fit therebetween. As will be seen, the locking means 90 is positioned at the end of the implement 10 remote from the securing means 55.

When the cutting implement is used as illustrated in FIG. 3, and when a sufficient pressure has to be applied it has been found desirable to provide gripping means 39 as a finger rest formed at the upper edge 42 of the supporting means 12 for the respective fingers 41 of the user. The gripping means 39 is formed by the dimensional relationship of the inner surface 95 of arm 92 and the inner edge 78 of the elements 72 and 74 in conjunction with the surface 42.

The ability to have transparent housing permits shelf life inspections from time to time with a minimal amount of labor. This is most important when one considers that tens of thousands and up to hundreds of thousands of these implements may be in use or storage at one time. Accordingly, either or both the supporting means 12 and handle means 15 may be of a transparent plastic material.

Although illustrative embodiments of the invention have been described in detail herein, with reference to the accompanying drawing, it is to be understood that the invention is not limited to those precise embodiments, and that various changes and modifications may be effected therein without departing from the scope or spirit of the invention, except in the appended claims.

We claim:

1. A cutting implement, comprising:

A. supporting means including an elongated body portion,

B. an elongated blade with a cutting edge extending along one edge thereof,

C. mounting means for maintaining said blade in fixed position relative to said supporting means with an exposed portion of said blade extending beyond said supporting means the complete length of said edge and extending in a plane substantially parallel to a surface of said supporting means, said mounting means including a pair of tongues extending transversely through said blade in said supporting means, D. handle means including an elongated body portion, E. chamber means extending longitudinally in said handle means and adapted to contain the exposed portion of said blade in the closed position of the implement, F. securing means pivotally connecting said supporting means to said handle means at substantially one end thereof so as to provide relative angular displacement of said supporting means relative to said handle means from a closed position in which the front surfaces of said supporting means and said handle means extend in overlapping abutting relation to each other with the exposed portion of said blade extending within said handle means, to an open position wherein the complete length of said cutting edge is exposed for use thereof with said body portion extending in a plane below said cutting edge, said securing means including a fastener extending transversely through said supporting means and said handle means, and said fastener retains the overlapping surfaces of said supporting means and said handle means under compression, G. stopping means extending relative to said supporting means and said handle means for limiting the travel of the supporting means relative to the handle means from its closed to open position, H. locking means associated with said handle means and said supporting means to retain the latter in a releasable fixed position in the closed position of the implement, and I. gripping means on said handle means to permit a firm grip by the user, said gripping means including a recess having a front surface extending in a substantially horizontal plane relative to said cutting edge with spaced apart end walls to receive the fingers of the user therebetween, such that a firm grip of the cutting implement is obtainable during use thereof.

2. A cutting implement as defined in claim 1, wherein ssaid locking means includes:

a. an element extending from the front surface of said handle means containing a recess, and b. a catch extending from one end of said supporting means adapted to extend within said recess in a friction fit therewith when said handle means and supporting means are in the closed position of the implement.

3. A cutting implement as defined in claim 2, wherein said locking means is positioned at the end of the implement remote from said securing means.

4. A cutting implement as defined in claim 2, wherein said recess extends transversely across said element and said catch is in resilient compressed engagement within the walls of said recess in said handle means to provide the friction fit therebetween when the implement is in its closed position.

5. A cutting implement as defined in claim 1, wherein said stopping means includes a surface on said supporting means having a face extending in a plane substantially parallel to a mating abutting surface on said handle means when the implement is in an open position.

6. A cutting implement as defined in claim 1, and further including retaining means for maintaining said handle means and supporting means in a releasable fixed position in the open position of the implement.

7. A cutting implement as defined in claim 1, wherein said chamber means is in the form of a channel longitudinally extending along siad handle means on the front surface thereof.

8. A cutting implement as defined in claim 1, a. wherein said supporting means includes a rear surface in substantiallly parallel spaced apart relation to said front surface, a pair of side surfaces extending in a plane substantially parallel to each other and perpendicular to said front and rear surfaces, and an end surface remote from said securing means, b. wherein said handle means includes a rear surface in substantially parallel spaced apart relation to said front surface, a pair of side surfaces extending in a plane substantially parallel to each other and perpendicular to said front and rear surfaces, and an end surface remote from said securing means, and c. wherein in the closed position of the implement the respective side surfaces of said supporting and handle means extend in a common plane and said end surfaces are in overlapping relation to each other, to obtain a rectangular configuration to the implement.

9. A cutting implement as defined in claim 1, a. wherein said blade is mounted along a plane substantially equidistant from both sides of said supporting means, and b. wherein said chamber extends in a plane substantially equidistant from both sides of said handle means.

10. A cutting implement as defined in claim 1, wherein said securing means includes:

a. a tab extending at one end of said supporting means, and b. a pair of spaced apart elements extending from one end of said handle means with said tab extending therebetween, said fastener extending transversely through said tab and said elements.

11. A cutting implement as defined in claim 1, wherein said handle means is of a transparent plastic material to permit visual inspection of the blade positioned in said chamber means in the closed position of the implement.

12. A cutting implement, comprising:

A. supporting means including an elongated body portion having a front surface, a rear surface in substantially parallel spaced apart relation to said front surface, a pair of side surfaces extending in a plane substantially parallel to each other and perpendicular to said front and rear surfaces, and an end surface, B. an elongated blade with a cutting edge extending along one surface thereof, C. mounting means for securing said blade in fixed position relative to said supporting means wherein a portion of said blade extends within said body portion and said blade edge extends in substantially parallel spaced relation to the front surface of said body portion the complete length thereof and spaced a distance from the end surface thereof, said mounting means including a pair of tongues extending transversely through said blade in said supporting means, D. handle means including an elongated body portion having a front surface and rear surface in substantially parallel spaced apart relation to said front surface, a pair of side surfaces extending in a plane substantially parallel to each other and perpendicular to said front and rear surfaces, and an end surface, E. chamber means extending longitudinally in said handle means along the front surface of said body portion and spaced a distance from the end surface thereof and adapted to contain said blade in the closed position of the cutting implement, F. securing means pivotally connecting said supporting means to said handle means, so as to provide relative angular displacement of said supporting means relative to said handle means at substantially one end thereof remote from the end surface, from a closed position in which the front surfaces of said supporting means and said handle means are in overlapping abutting relation to each other with said blade extending within said chamber means and the respective side and end surfaces of said supporting and handle means extend respectively in a common plane to obtain a rectangular configuration to the implement, to an extended position wherein the complete length of said cutting edge is exposed for use thereof with said body portion extending in a plane below said cutting edge, said securing means including a fastener extending transversely through said supporting means and said handle means and said fastener retains the overlapping surfaces of said supporting means and said handle means under compression, G. stopping means extending relative to said supporting means and said handle means for limiting the travel of the supporting means relative to the handle means from its closed to open position, wherein in the open position of the implement the rear surface of said supporting means and the front surface of said handle means extend in substantially a common plane, and in said closed position the blade is contained within said supporting means and handle means and hidden from view, H. locking means associated with said handle means and supporting means to retain the latter in a releasable fixed position in the closed position of the implement, and I. gripping means on said handle means to permit a firm grip by the user, said gripping means including a recess having a front surface extending in a substantially horizontal plane relative to said cutting edge with spaced apart end walls to receive the fingers of the user therebetween, such that a firm grip of the cutting implement is obtainable during use thereof.

13. A cutting implement as defined in claim 12, wherein said stopping means includes a surface on said supporting means extending in a plane substantially parallel to a mating abutting surface on said handle means when the implement is in an open position.

14. A cutting implement as defined in claim 12, and further including retaining means for maintaining said handle means and supporting means in a releasable fixed position in the open position of the implement.

15. A cutting implement as defined in claim 12, wherein said locking means includes:

a. an element extending from the front surface of said handle means containing a recess, and b. a catch extending from one end of said supporting means adapted to extend within said recess in a friction fit therewith when said handle means and supporting means are in the closed position of the implement.

16. A cutting implement as defined in claim 15, wherein said recess extends transversely across said element and said catch is in resilient compressed engagement within the walls of said recess in said handle means to provide the friction fit therebetween when the implement is in its closed position.

17. A cutting implement as defined in claim 12, a. wherein said blade is mounted along a plane substantially equidistant from both sides of said supporting means, and b. wherein said chamber extends in a plane substantially equidistant from both sides of said handle means.

18. A cutting implement as defined in claim 12, wherein said handle means is of a transparent plastic material to permit visual inspection of the blade positioned in said chamber means in the closed position of the implement.

19. A cutting implement, comprising:

A. supporting means including an elongated body portion having a front surface and rear surface and rear surface in substantially parallel spaced apart relation to said front surface, a pair of side surfaces extending in a plane substantially parallel to each other and perpendicular to said front and rear surfaces, B. an elongated blade with a cutting edge extending along one surface thereof, C. mounting means for securing said blade in fixed position relative to said supporting means wherein a portion of said blade extends within said body portion and said blade edge extends in substantially parallel spaced relation to the front surface of said body portion and spaced a distance from the end surfaces thereof, said mounting means including a pair of tongues extending transversely through said blade in said supporting means, D. handle means including an elongated body portion having:

a. a front surface, b. a rear surface in substantially parallel spaced apart relation to said front surface, c. a pair of side surfaces extending in a plane substantially parallel to each other and perpendicular to said front and rear surfaces, d. an element extending from said front surface at one end thereof, and e. a pair of elements extending from said front surface at the opposite end thereof, the terminal end of said elements defining a common plane, in substantially parallel spaced relation to said front surface, E. chamber means extending longitudinally in said handle means along the front surface of said body portion and spaced a distance from each end thereof and adapted to contain said blade in the closed position of the cutting implement, F. securing means pivotally connecting said supporting means to said handle means, so as to provide relative angular displacement of said supporting means relative to said handle means at substantially one end thereof from an open position wherein said cutting edge is exposed for use thereof to a closed position in which the front surfaces of said support means and said handle means are in overlapping abutting relation to each other with said blade extending within said chamber means, the respective side surfaces of said supporting and handle means extending respectively in a common plane, and said rear surface of said supporting means extending in a common plane with the terminal end of said elements to obtain a rectangular configuration to the implement, said securing means including:

a. a tab at one end of said supporting means extending between said pair of spaced apart elements, and b. a fastener extending transversely through said tab and said elements, G. stopping means extending relative to said supporting means and said handle means for limiting the travel of the supporting means relative to the handle means from its closed to open position, wherein in the open position of the implement the front surface of said supporting means and the rear surface of sid handle means extend in substantially a common plane, and in said closed position the blade is contained within said supporting means and handle means and hidden from view, H. locking means associated with said handle means and supporting means to retain the latter in a releasable fixed position in the closed position of the implement, said locking means including:

a. a recess on said element extending from the front surface of said handle means, and b. a catch extending from one end of said supporting means adapted to extend within said recess in a friction fit therewith when said handle means and supporting means are in the closed position of the implement, and I. gripping means on said handle means to permit a firm grip by the user.

20. A cutting implement as defined in claim 19, wherein said handle means is of a transparent plastic material to permit visual inspection of the blade positioned in said chamber means in the closed position of the implement.

21. A cutting implement as defined in claim 19, wherein said recess extends transversely across said element and said catch is in resilient compressed engagement within the walls of said recess in said handle means to provide the friction fit therebetween when the implement is in its closed position.

22. A cutting implement as defined in claim 19, wherein said stopping means includes a surface on said supporting means having a face extending in a plane substantially parallel to a mating abutting surface on said handle means when the implement is in an open position.

23. A cutting implement as defined in claim 19, and further including retaining means for maintaining said handle means and supporting means in a releasable fixed position in the open position of the implement.

24. A cutting implement as defined in claim 19, wherein said fastener retains the overlapping surfaces of said supporting means and said handle means under compression.

* * * * *